US011891827B1

(12) United States Patent
Oliphant

(10) Patent No.: US 11,891,827 B1
(45) Date of Patent: Feb. 6, 2024

(54) DEVICE AND METHOD FOR REPAIRING A POLE

(71) Applicant: Exo Group LLC, Magnolia, TX (US)

(72) Inventor: Wesley J. Oliphant, Tomball, TX (US)

(73) Assignee: Exo Group LLC, Magnolia, TX (US)

( * ) Notice: Subject to any disclaimer, the term of this patent is extended or adjusted under 35 U.S.C. 154(b) by 0 days.

(21) Appl. No.: 17/487,554

(22) Filed: Sep. 28, 2021

Related U.S. Application Data

(60) Provisional application No. 63/118,995, filed on Nov. 30, 2020.

(51) Int. Cl.
*E04H 12/22* (2006.01)
*E02D 5/64* (2006.01)
*E04G 23/02* (2006.01)

(52) U.S. Cl.
CPC ..... *E04H 12/2292* (2013.01); *E02D 5/64* (2013.01); *E04G 23/0225* (2013.01)

(58) Field of Classification Search
CPC ..... E04H 12/2292; E04G 23/0218; E04G 23/0225; E02D 5/64; E02D 5/226; E02D 5/60
See application file for complete search history.

(56) References Cited

U.S. PATENT DOCUMENTS 7,104,219 B2 * 9/2006 Frantz ..... A01K 61/54 119/221
8,628,275 B1 * 1/2014 Trader ..... E02D 5/64 405/211
10,870,999 B1 * 12/2020 Oliphant ..... E04G 23/0225
2003/0163960 A1 * 9/2003 Hadden ..... E04C 3/30 52/514
2005/0183364 A1 * 8/2005 Cash ..... E04H 12/2292 52/296
2016/0060889 A1 * 3/2016 Tedesco ..... E04H 12/2238 52/514

* cited by examiner

*Primary Examiner* — Andrew J Triggs
(74) *Attorney, Agent, or Firm* — Duncan Galloway Greenwald PLLC; Kevin T. Duncan

(57) ABSTRACT

A device and method for repairing a pole wherein pre-fabricated brackets are bolted together in the field to form a clamping ring, or exoskeletal splint around the pole, and wherein different sets of brackets can form different rings that are stacked and bolted together to clamp against and span enough of the height of the pole to provide the desired support.

7 Claims, 8 Drawing Sheets

DEVICE AND METHOD FOR REPAIRING A POLE

BACKGROUND

This application claims priority from U.S. Provisional Application Ser. No. 63/118,995 filed Nov. 30, 2020, which is hereby incorporated herein by reference.

The present invention relates to a device and method for repairing a pole. More specifically, it relates to the use of an exoskeletal "splint" to repair a failed or failing pole in the field.

Metal or wooden poles often are embedded directly into the ground. These poles may develop severe corrosion or decay, particularly at or slightly below the groundline. Even though a problem of this type may be addressed on steel poles by welding reinforcing collars or other similar work, this is not always a good option due to factors such as weather, depth below ground that the reinforcement needs to be placed, the availability of good, qualified welders to produce a high quality repair in the field, and the time and expense involved.

SUMMARY

One embodiment of the present invention provides a device and method for field-repairing a pole using several brackets that are arranged side by side, to wrap around the pole. The brackets are bolted together to tighten against the pole, forming a clamping exoskeletal "splint". A second embodiment provides a device and method for field repairing a pole, similar to the first embodiment, but including bolting directly to the pole to be repaired rather than relying only on clamping onto the pole. In both embodiments, the brackets are fabricated in a controlled environment, in a qualified shop, and readily can be installed in the field by relatively unskilled labor following straightforward instructions. The brackets surround the pole and are bolted together, with the bolts being tightened to press the rear faces of the brackets against the surface of the pole and provide a clamping force against the pole to reinforce the pole.

DESCRIPTION

Figure 1:
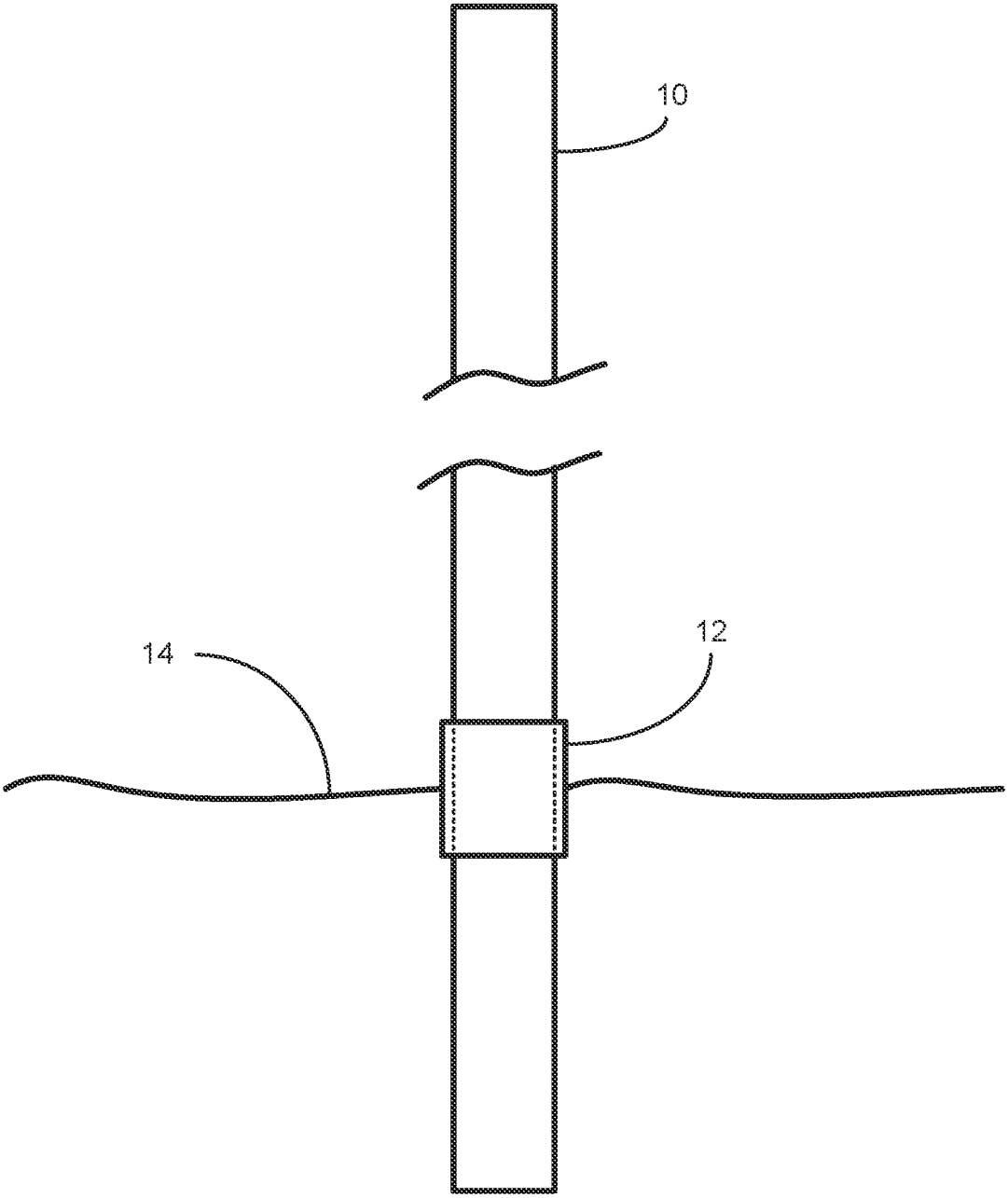
Fig 1 Prior Art
FIG. 1 is a partially broken away, side view of an existing, prior art pole buried directly in the ground.
Figure 2:
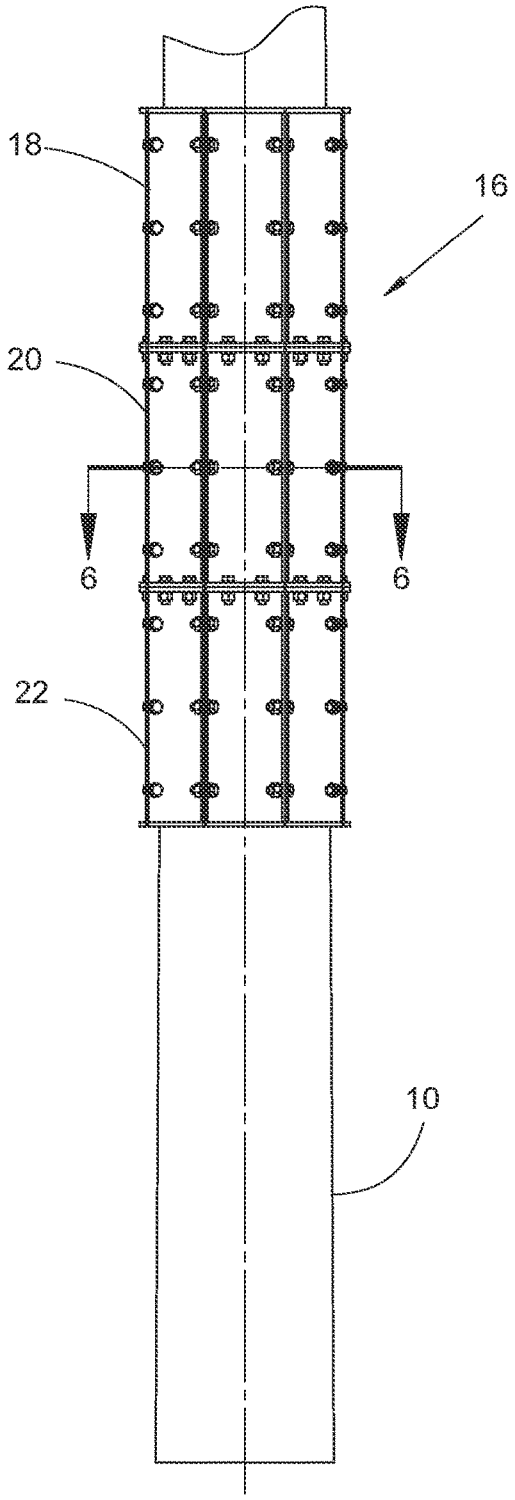
FIG. 2 is a broken away, side view, of the pole of FIG. 1 with an embodiment of the brackets of the present invention installed.
Figure 3:
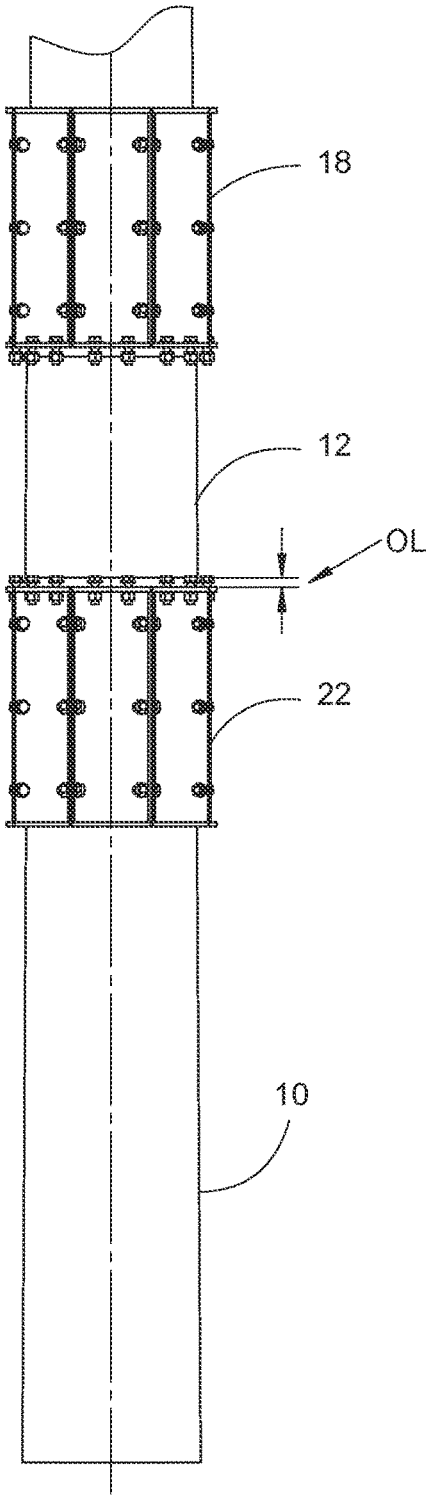
FIG. 3 is a broken away, side view, similar to that of FIG. 2, but with the center portion of the splint removed to show the sleeve of the original pole of FIG. 1.
Figure 4:
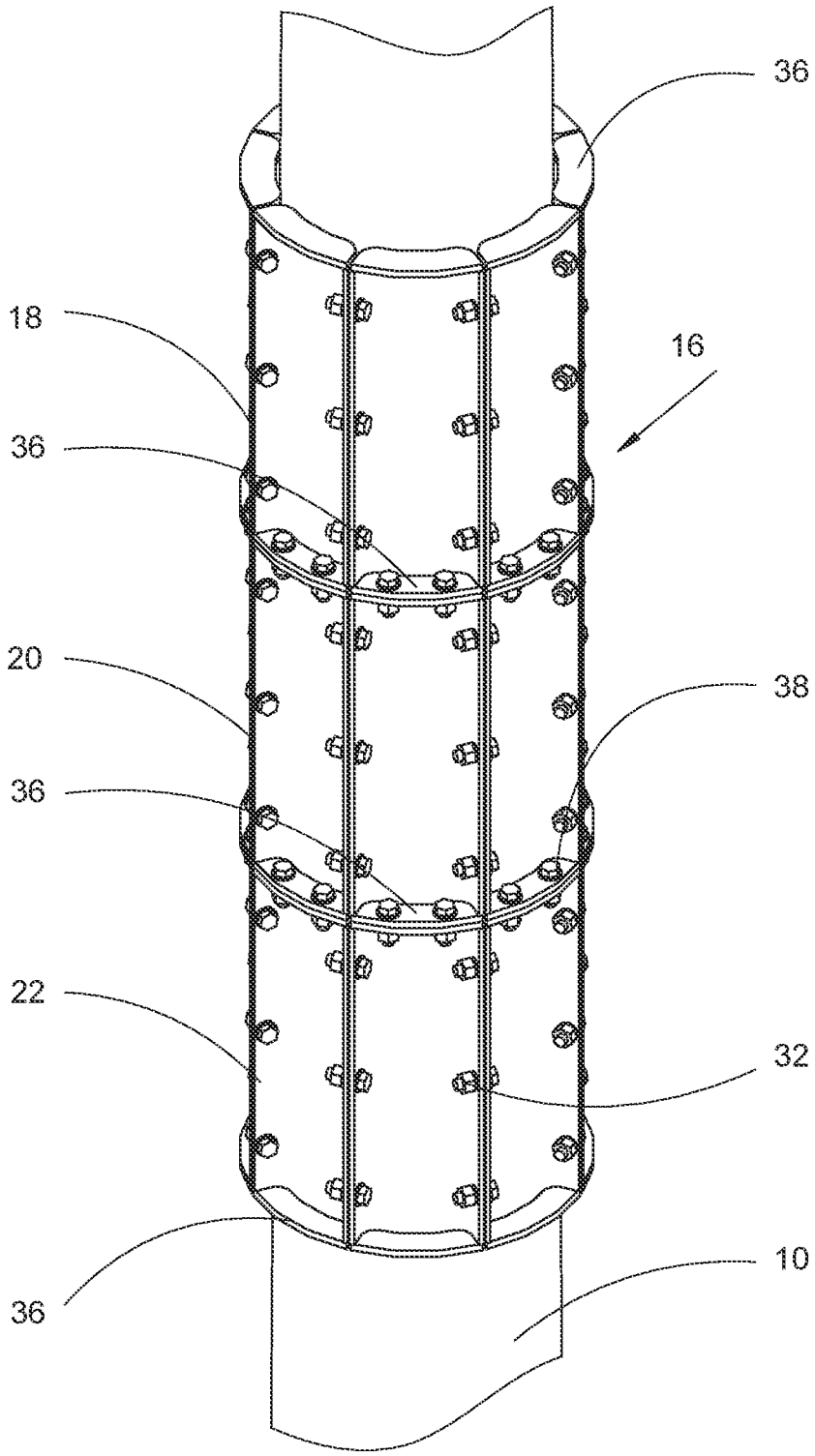
FIG. 4 is a broken away, perspective view of the pole of FIG. 2.

FIG. 1 shows a pole 10 with a ground sleeve 12 located along the area where the pole 10 and the groundline 14 meet. Typically, this type of pole 10, which may be a metal pole or a wooden pole, is installed in the ground by first digging a hole (not shown) in the ground. The bottom end of the pole 10 is then placed in the ground, and the ground (which may be soil, gravel, or even concrete) is backfilled around the pole 10. This direct embedment into the ground is a common type of pole installation. If the pole 10 is made of steel, a ground sleeve 12 may be welded to the pole 10. In this embodiment, the ground sleeve 12 is about ¼ inch thick and surrounds the pole 10 for a vertical distance of about two feet or more. The sleeve 12 provides additional corrosion protection for the pole 10.

Nevertheless, the moisture-retaining ground, and the presence of air at the intersection of the pole 10 and sleeve 12 with the groundline 14 may result in accelerated and severe corrosion or decay of the sleeve 12 and the pole 10, which may cause the pole 10 to be at risk of failure.

FIGS. 2-8 show a plurality of fabricated brackets 18, 20, 22, which are bolted together around the pole 10 and sleeve 12, clamping against the pole 10 and sleeve 12 to form a supportive splint 16, which repairs the failing pole 10. In this embodiment, (See FIGS. 2 and 3) the splint 16 includes upper, middle, and lower sets of brackets 18, 20, 22 respectively. The top and bottom sets of brackets 18, 22 are identical to each other. The middle set of brackets 20 is nearly identical to the top and bottom sets of brackets 18, 22 but may have a different height than the top and bottom brackets 18, 22 in order to match the height of the sleeve 12.

In this particular embodiment, the middle brackets 20 are twenty-six inches tall, while the top and bottom brackets 18, 22 are thirty inches tall. Of course, these dimensions can be customized for other specific pole designs. Segmenting the splint 16 into different bands or rings (in this case upper, middle and lower) allows the splint to accommodate slight variances in the circumference of the pole. In this case, the pole 10 is slightly tapered, so the circumference of the pole 10 at the height of the lower brackets 22 is a bit larger than the circumference of the pole 10 at the height of the upper brackets 18. Also, the circumference of the pole 10 at the height of the middle brackets 20 is enlarged due to the ground sleeve 12.

The middle brackets 20 extend one inch above and one inch below the ground sleeve 12, so they span a bit above and below the ground sleeve 12. This can be seen in FIG. 3, where a distance OL remains uncovered above and below the ground sleeve 12 when the middle brackets 20 are removed. The top and bottom brackets 18, 22 have a height sufficient to provide the needed support to the pole when the clamping splint 16 is assembled, so, depending upon the pole, they may have the same height as the middle brackets 20 or may be taller or shorter than the middle brackets 20. The upper brackets 18 are arranged around the circumference of the pole 10, with slight gaps between the sides of adjacent upper brackets 18, and the brackets 18 are bolted together to press the rear surfaces of the brackets 18 against the outer surface of the pole 10, which produces a clamping force against the pole 10. The same is true of the middle brackets 20 and the lower brackets 22. Also, the middle brackets 20 are bolted to the upper and lower brackets 18, 22. All three rings of brackets 18, 20, 22 work together to form a compressive splint 16 that surrounds and clamps against the pole 10. As was explained above, the circumference of the pole around which each set of brackets clamps may vary a bit, since the pole 10 may be tapered, and since the ground sleeve 12 increases the diameter around which the middle brackets 20 clamp. The bolt holes on the flanges 36 of the brackets may be slotted or enlarged to accommodate these differences in circumference.

Figure 7:
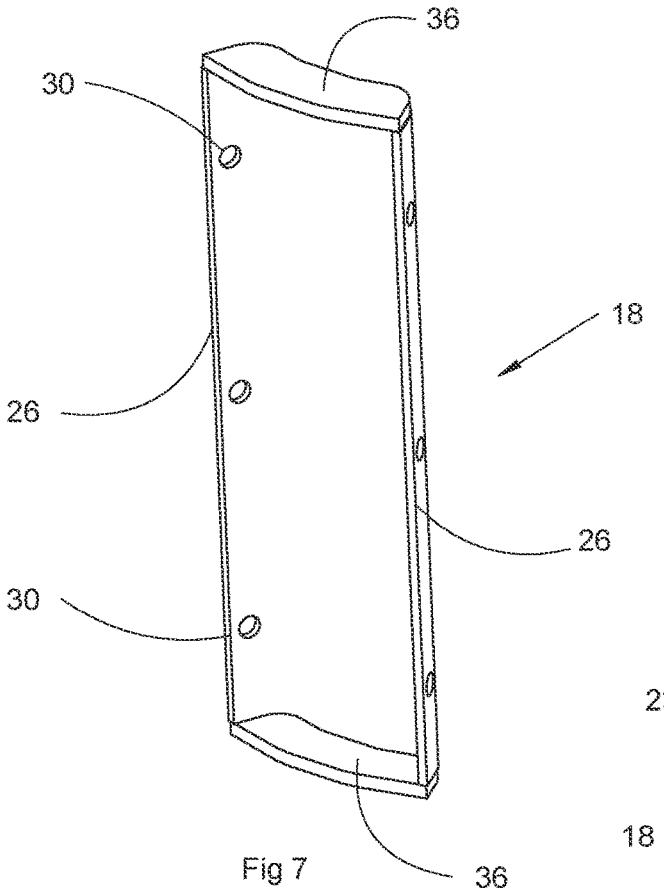
FIG. 7 is an outside perspective view of one of the brackets of FIGS. 2-6.
Figure 8:
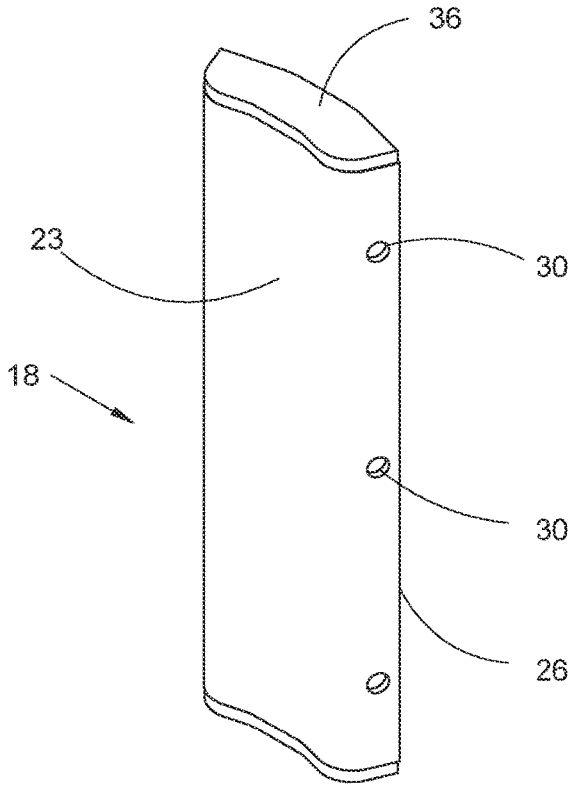
FIG. 8 is a pole-side perspective view of the bracket of FIG. 7.
Figure 9:
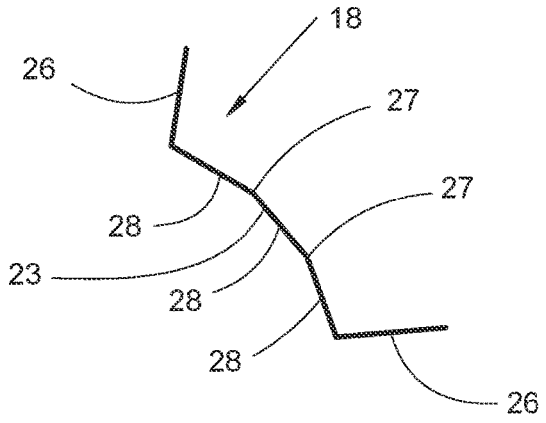
FIG. 9 is a sketch of the profile of the bracket of FIG. 7.
Figure 10:
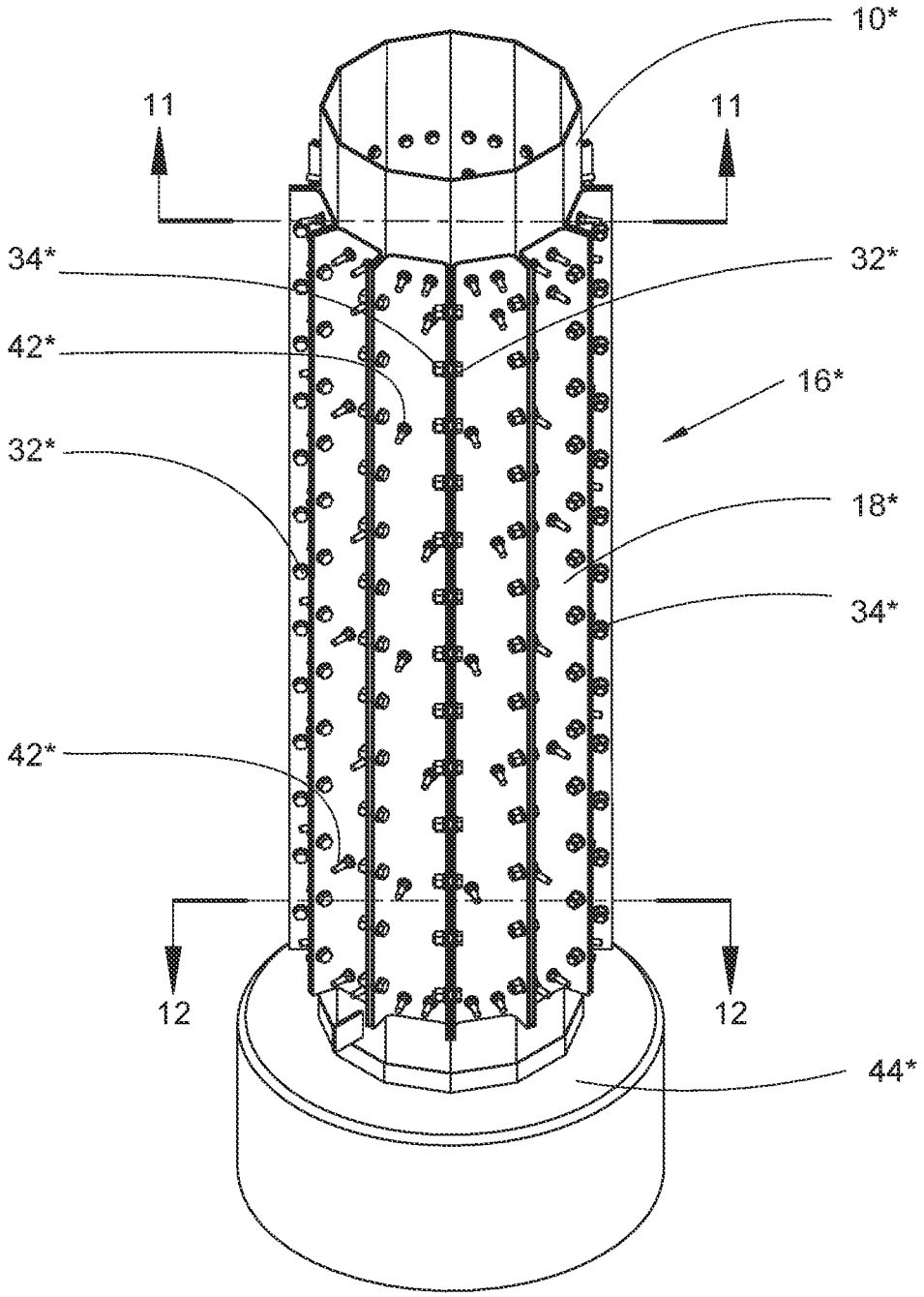
FIG. 10 is a perspective view, similar to that of FIG. 4, but for a second embodiment of a splint for the pole, wherein the pole is mounted on a base.

The brackets 18, 20, 22 may be fabricated in any known manner, including casting, welding, etc. FIGS. 7, 8, and 9 show the upper brackets 18, but the other brackets 20, 22 are similar if not identical.

Each of the brackets 18 is elongated in a vertical direction. Each bracket 18 has an elongated rear wrapping wall 23 with a concave-profiled face for abutting and wrapping around a portion of the circumference of the surface of the pole 10. Left and right side walls 26 extend forwardly from the wrapping wall 23. The wrapping wall 23 and the left and right side walls 26 have top and bottom edges. A top flange 36 projects forwardly from the wrapping wall and connects the top edge of the wrapping wall 23 to the top edges of the left and right side walls. A bottom flange 36 projects forwardly from the wrapping wall 23 and connects the bottom edge of the wrapping wall 23 to the bottom edges of the left and right side walls. The rear edge of each flange 36 aligns with the rear face of the wrapping wall 23. The sides of each flange 36 align with the side walls 26.

Figure 5:
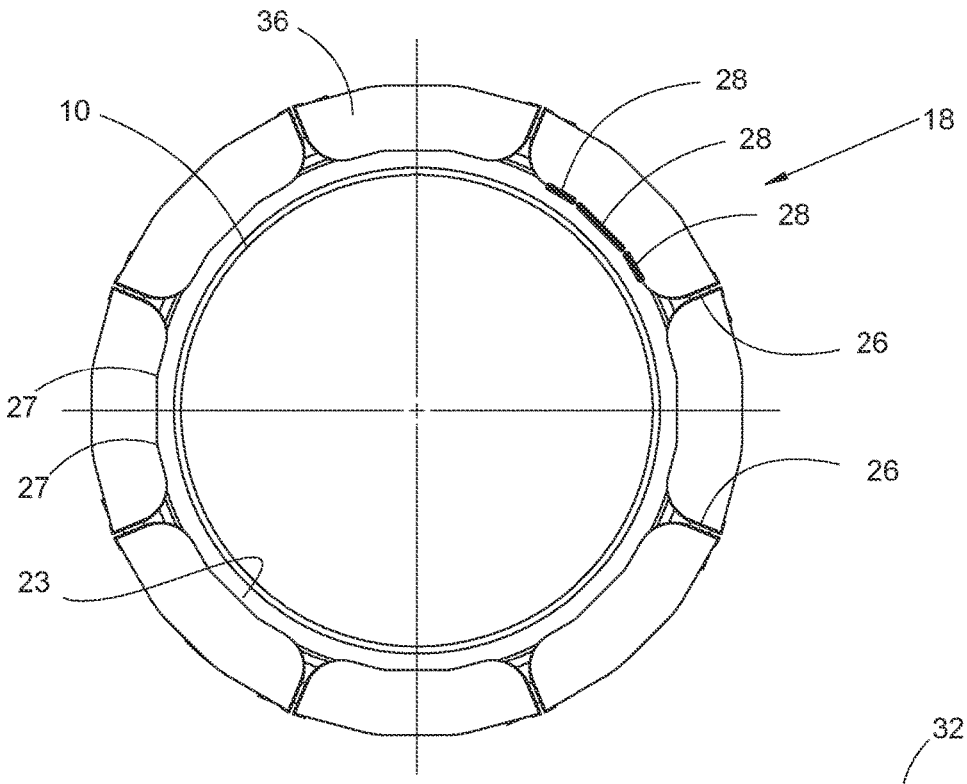
FIG. 5 is a top view of the pole of FIG. 2.
Figure 6:
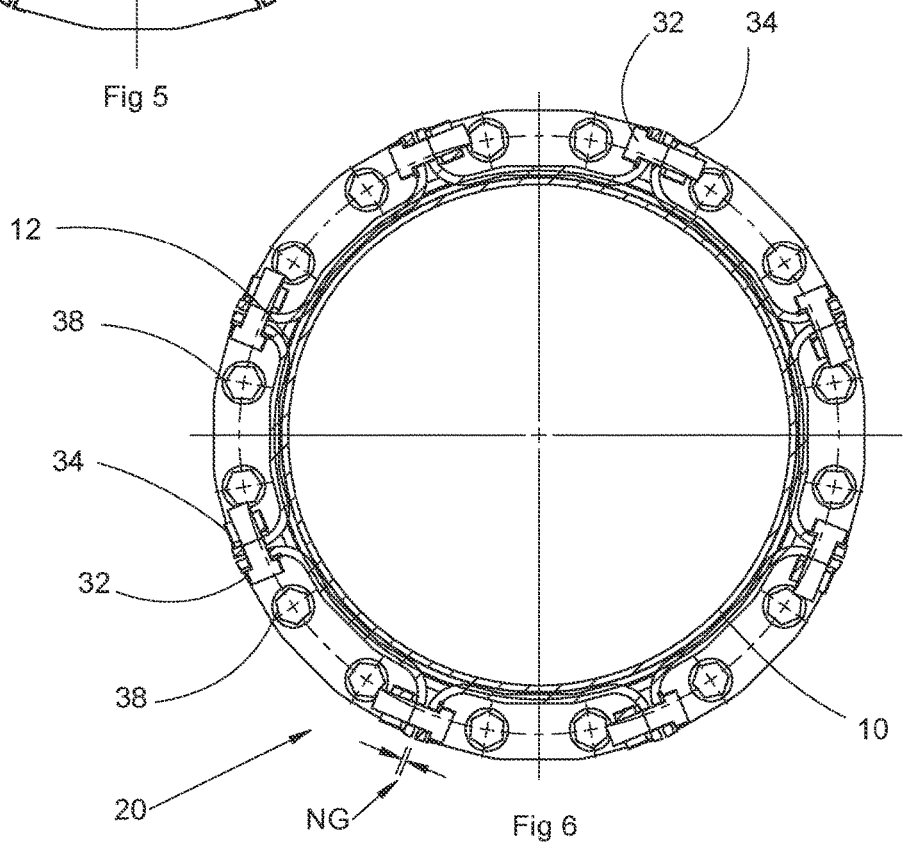
FIG. 6 is a section view along line 6-6 of FIG. 2.

When the plurality of brackets 18 is arranged side by side, with slight gaps between the left side wall 26 of each bracket 18 and the right side wall 26 of the next adjacent bracket 18, the plurality of wrapping walls 23 wrap around the circumference of the pole 10, as shown in FIGS. 5 and 6. As shown in FIG. 6, when the bolts 34 extending through the aligned openings in the adjacent side walls 26 are tightened, reducing the gaps between the adjacent side walls 26 of the adjacent brackets 18, the concave rear faces of the wrapping walls 23 abut the outer surface of the pole 10 and press against the pole 10, clamping around the outer surface of the pole 10.

In this embodiment, the bracket 18 is fabricated from a sheet of steel, using a press brake. The elongated left and right sides 26 are bent forwardly from the wrapping wall 23. Two intermediate bend lines 27 (See FIG. 9) create slight angles between the three flats 28 of the wrapping wall 23 to form the concave-profiled, wrapping rear surface that wraps part-way around the curved outer surface of the pole 10. The top flange 36 is welded across the top, and the bottom flange is welded across the bottom of the bent sheet. While this embodiment uses a press brake and forms flats, it also would be possible to form the concave surface with a smooth, arcuate shape, or other concave-profiled shape to wrap around the pole 10, as desired.

The sides 26 define through-openings 30 (See FIGS. 7 and 8) for bolting the brackets 18 to each other to form a ring that surrounds the pole 10. (See FIG. 6, which shows the bolts 32 and nuts 34 bolting the brackets 18 together.) Referring to FIG. 6, there is a small gap or nominal gap "NG" between the sides 26 of adjacent brackets 18, which is spanned by the bolts 32. The size of this nominal gap NG may be adjusted to permit the same brackets 18 to be used on a range of diameters of poles. When the brackets 18 are bolted together, the bolts can be tightened to reduce the nominal gap NG, which reduces the diameter of the ring of brackets and causes the brackets 18 to press against the outer surface of the pole 10, clamping the brackets 18 against the pole 10.

The three flats 28 on the rear face of each bracket 18, multiplied by the eight brackets 18 on the ring, result in a 24-sided shape which closely approximates a circular cross-section inner surface when the set of brackets 18 is bolted together around the pole 10.

As best shown in FIGS. 5 and 6, each bracket is a segment of its respective upper, middle, or lower ring. In this embodiment, there are eight brackets per ring. The bracket 18 in the upper right of FIG. 5 shows that, in this embodiment, each bracket is fabricated with three longitudinal flats 28, each of which is at least partially in contact with the outer surface of the pole 10 (or of the sleeve 12 in the case of the middle brackets 20).

The brackets 18, 20, 22 in this embodiment are made from 5/16 inch thick galvanized steel. (Other materials and dimensions could be used, as desired.) The flanges 36 (See FIGS. 7 and 8) are welded across the top and bottom ends of each bracket 18, tying together both sides 26 and the wrapping wall 23 at the top and bottom ends. These particular flanges 36 are made of ½ inch thick galvanized steel and define a plurality of bolt holes (See FIG. 6) for bolting the middle brackets 20 to the upper and lower brackets 18, 22. These drawings do not show the holes through the flanges 36 in the fabricated brackets 18, 20, 22. The holes may be formed in the flanges 36 when the brackets are being fabricated, or they may be drilled by the installer during assembly. If they are formed during fabrication, at least some of the holes may be oversized or slotted to accommodate differences in the inside diameter of each ring when the rings are clamped around their respective portions of the pole 10. All of the fabricated brackets 18, 20, 22 are protected from potential corrosion by hot dip galvanizing and application of an appropriate protective barrier coating prior to installation.

Installation:

To install the brackets 18, 20, 22 on a pole 10, the user first digs around the base of the pole deep enough to uncover the sleeve 12 and the portion of the pole 10 below ground that is to be surrounded by the bracket arrangement. Once enough material has been removed (and safely shored up, if necessary) to be able to work comfortably around the pole 10, the dirt and loose material is cleaned off of the pole 10 and the sleeve 12. Although not part of this invention, a best practice would be to remove all corrosion product on the pole 10 or sleeve 12 and coat them with a suitable protective barrier coating to prevent further degradation. The rings of brackets 18, 20, 22 are assembled around the pole 10 and sleeve 12 and are bolted together, thereby clamping each ring of brackets 18, 20, 22 tightly against the pole, and then the adjacent rings 18, 20, 22 are bolted to each other by bolting through adjacent flanges 36. This connects each ring of brackets 18, 20, 22 rigidly to the next adjacent ring, with the bottom flanges 36 of the upper brackets 18 resting on and bolted to the upper flanges 36 of the middle brackets 20, and the bottom flanges 36 of the middle brackets 20 resting on and bolted to the upper flanges 36 of the lower brackets 20, so all the brackets function together as a single, rigid, clamping splint to support the pole 10 above and below ground level for a distance substantially above and below the ground sleeve 12. As was explained earlier, the middle set of brackets 20 preferably extends slightly above and below the ground sleeve 12—in this embodiment one inch above and one inch below the ground sleeve 12.

After all the bolts 38 (See FIG. 6) are inserted and tightened, the ground around the pole 10 is backfilled to its original condition.

FIGS. 10-14 show a second embodiment of a splint 16* around a pole 10*. In this case, the pole 10* is mounted on a base 44*. This splint 16* is similar to the splint 16 described above but preferably is both clamped onto the pole 10* and bolted onto the pole 10*, as described below.

The splint 16* includes a plurality of brackets 18* forming a single band or ring around the pole 10*. Each bracket 18* is similar to the brackets 18 of the previous splint 16. In this splint 16*, the brackets 18* are longer than the previous brackets 18 so as to cover the entire area to be reinforced/repaired with a single band around the pole 10*. Also, the brackets 18* have no flanges, as compared to the brackets 18. The brackets 18* could have flanges at their respective ends, if desired and/or if needed, for strength and/or for installing more than one ring around the area to be repaired and bolting adjacent rings together through the flanges, as in the previously described embodiment 16.

It also may be noted that the elongated wrapping walls 23* of these brackets 18* are flat and are designed to press against the flat sides of a multi-sided pole 10*. Of course, the brackets 18* also may be used to repair a pole 10 having a circular cross-section. Also, each bracket 18* may have a multi-sided back (similar to the multi-sided flats 28 of the wrapping wall 23 shown in FIG. 9 for the splint 16), if desired, to better match the profile of a pole 10 with a circular cross-section.

Figure 11:
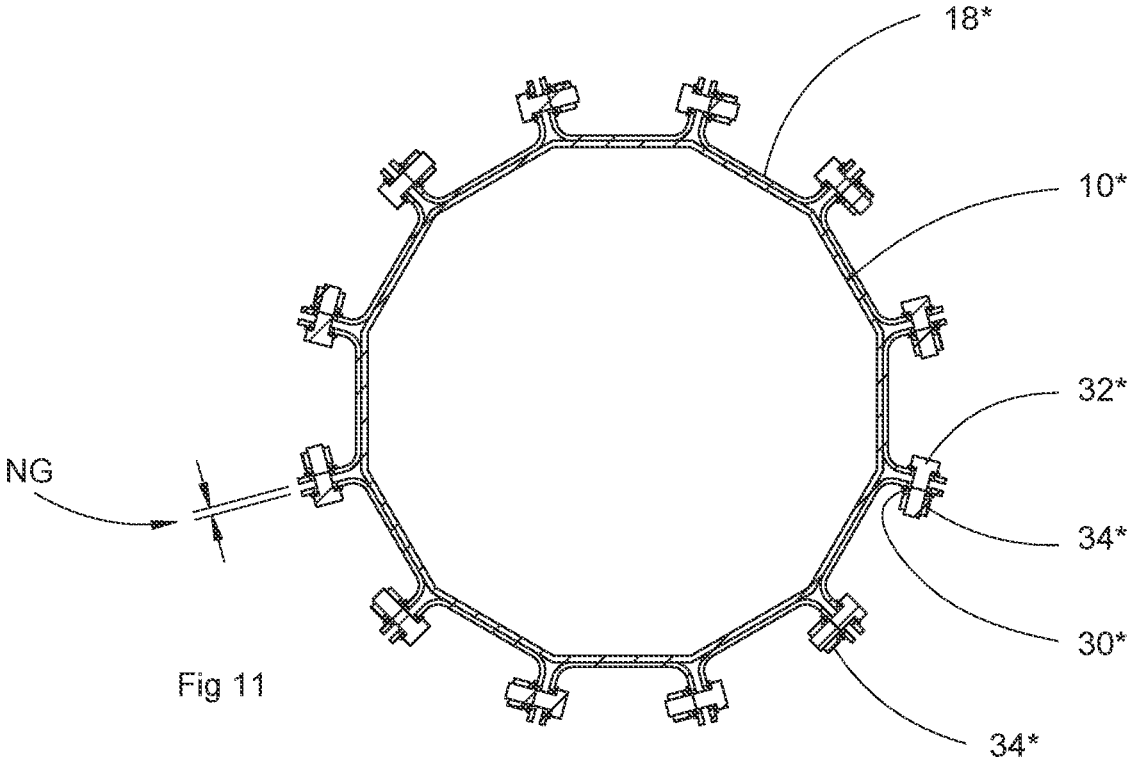
FIG. 11 is a section view along line 11-11 of FIG. 10 as it could be installed if the splint were only clamped onto the pole, without bolting the splint to the pole.
Figure 12:
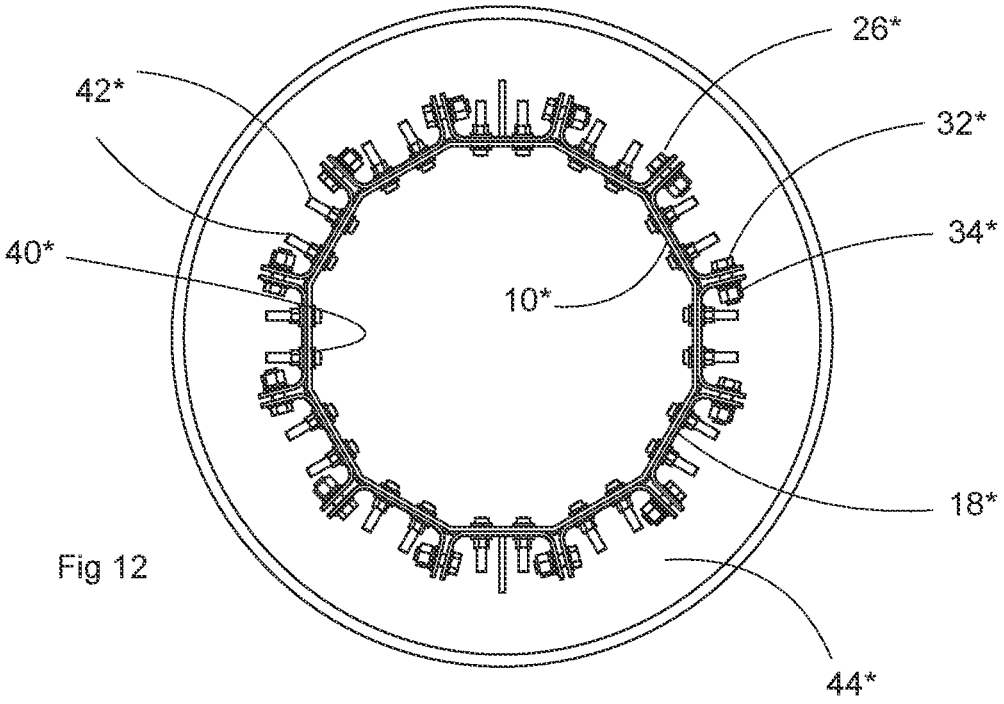
FIG. 12 is a view along line 12-12 of FIG. 10, with the splint both clamped and bolted to the pole.
Figure 13:
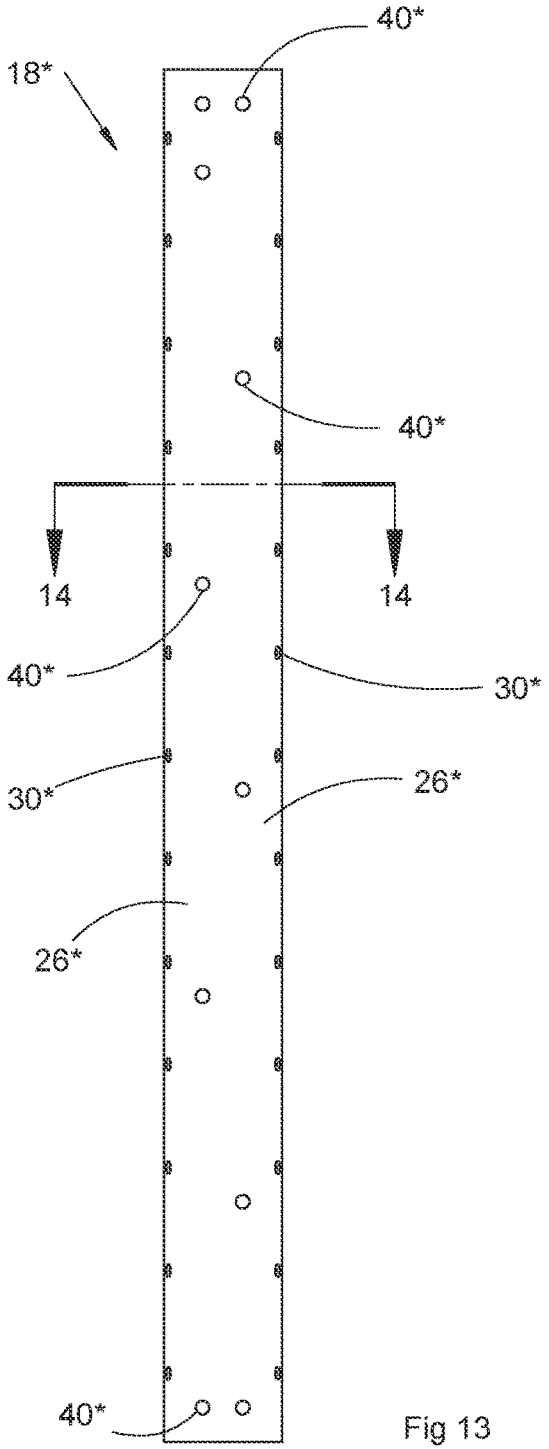
FIG. 13 is a front view of one of the brackets of FIG. 10.
Figure 14:
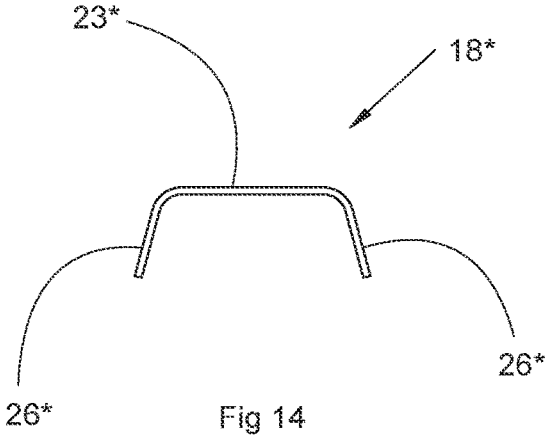
FIG. 14 is a section view along line 14-14 of FIG. 13.

The side walls 26* (See FIGS. 13 and 14) of the brackets 18* define through openings 30* (See FIGS. 11, 12, and 14) for bolting (using bolts 32* and nuts 34*, See FIGS. 11 and 12). When the bolts 34* extending through the aligned openings in the adjacent side walls 26* are tightened, reducing the gaps NG (See FIG. 11) between adjacent brackets 18*, the diameter of the ring of brackets 18* is reduced until the rear faces of the wrapping walls 23* abut the outer surface of the pole 10* and press against the pole 10*, clamping the ring of brackets 18* against the pole 10*.

When the plurality of brackets 18* is arranged side by side, with slight gaps NG between the left side wall 26* of each bracket 18* and the right side wall 26* of the next adjacent bracket 18*, the ring of wrapping walls 23* wraps around the circumference of the pole 10*, clamping the splint 16* to the pole 10*.

The wrapping walls 23* define a plurality of through openings 40* (See FIG. 13), which are used to secure the splint 16* to the pole 10* using blind fasteners 42*. Blind fasteners are a type of fastener that can be installed having access only to one side, as in this case, where the installer does not have access to the interior of the pole 10*. Blind fasteners usually are multi-piece assemblies, which can be installed and tightened from one side of the workpiece. Typical examples of blind fasteners used in higher strength structural areas are Ajax™ bolts (manufactured by Ajax Fasteners of Australia) and ForgBolts™ (manufactured by Paul J. Ford and Company of Columbus, Ohio) and are well known in the industry. Other types of blind fasteners also are known in the art.

The installation of this splint 16* is similar to the installation of the splint 16, except it is generally simpler as there is (typically) a single ring or band of brackets around the pole 10*, so the installer does not have to secure multiple rings of brackets to each other. However, each bracket 18* is not only bolted to its adjacent brackets 18*; each bracket 18* also is secured to the pole 10* by bolting (or screwing) it in instead of simply clamping around the pole 10* (as is the case for the splint 16 described earlier).

As was the case for the splint 16, during installation of the splint 16*, the installer is careful to leave a gap NG (as shown in FIG. 11) between adjacent side walls 26* of the brackets 18* so that the brackets 18* may snug up against the pole 10* as the bolts 32* are tightened up, clamping the splint 16* onto the pole 10*. The fasteners 42* are then installed to further secure the splint 16* to the pole 10*.

It will be obvious to those skilled in the art that modifications could be made to the embodiments described above without departing from the scope of the present invention as claimed. For instance, the dimensions of the brackets could be changed, each set of brackets could be formed using more (or less) than eight brackets, and there could be more or less than three rings (bands) of brackets, if desired.

What is claimed is:

1. An arrangement for reinforcing a pole wall having a circumference, comprising:

a plurality of first brackets, each of said first brackets being elongated in a vertical direction, having a first elongated rear wrapping wall with a concave-profiled rear face for directly abutting and wrapping around an outwardly facing portion of the circumference;

first left and right side walls extending outwardly from said first wrapping wall; said first wrapping wall and first left and right side walls having top and bottom edges;

a first top flange projecting outwardly from said first wrapping wall and connecting the top edge of said first wrapping wall to the top edges of said first left and right side walls;

a first bottom flange projecting outwardly from said first wrapping wall and connecting the bottom edge of said first wrapping wall to the bottom edges of said first left and right side walls; and a plurality of blind fasteners for securing said plurality of first wrapping walls to the pole wall, wherein said plurality of first wrapping walls defines a plurality of through openings configured to align with complementary pole through openings defined in the pole wall circumference, the plurality of blind fasteners configured to secure said plurality of first wrapping walls to the pole wall through said through openings in said plurality of first wrapping walls and through said complementary pole through openings defined in the pole wall circumference;

wherein, when said plurality of first brackets is arranged side by side, with slight gaps between the first left side wall of each first bracket and the first right side wall of an adjacent first bracket, said plurality of first wrapping walls forms a first tubular shape with a diameter, for wrapping around the circumference.

2. An arrangement for reinforcing a pole having a circumference as recited in claim 1, wherein said first left and right side walls define a plurality of aligned openings; and further comprising a plurality of bolts and nuts, wherein said bolts extend through said aligned openings to secure the adjacent first side walls of adjacent first brackets together, such that tightening said nuts on said bolts reduces the diameter of said tubular shape in order to press said first concave-profiled rear faces of said first wrapping walls against said circumference.

3. An arrangement for reinforcing a pole having a circumference as recited in claim 2, wherein each of said wrapping walls defines a plurality of elongated flat rear surfaces.

4. An arrangement for reinforcing a pole having a circumference as recited in claim 1, and further comprising:

a plurality of second brackets, each of said second brackets being elongated in a vertical direction, having a second elongated rear wrapping wall with a concave-profiled rear face for abutting and wrapping around a portion of the circumference; second left and right side walls extending outwardly from said second wrapping wall; said second wrapping wall and second left and right side walls having top and bottom edges; a second top flange projecting outwardly from said second wrapping wall and connecting the top edge of said second wrapping wall to the top edges of said second left and right side walls; a second bottom flange projecting outwardly from said second wrapping wall and connecting the bottom edge of said second wrapping wall to the bottom edges of said second left and right side walls; wherein, when said plurality of second brackets is arranged side by side, with slight gaps between the second left side wall of each second bracket and the second right side wall of the next adjacent second bracket, said plurality of second wrapping walls forms a second tubular shape with a second diameter, for wrapping around the circumference; and wherein said first bottom flanges define a plurality of through openings, and said second top flanges define a plurality of through openings that are aligned with said through openings in said first bottom flanges, so that, when said first brackets are arranged to form a first tubular shape, and said second brackets are arranged to form a second tubular shape below said first tubular shape, said first bottom flanges can be bolted to said second top flanges by bolts extending through said through openings.

5. An arrangement for reinforcing a pole having a circumference as recited in claim 1, wherein the pole circumference tapers from a greater diameter at a lower portion to a lesser diameter at an upward portion, and wherein the plurality of brackets are configured to taper in similar manner to accommodate the tapering of the pole circumference.

6. An arrangement for reinforcing a pole wall having a circumference, comprising:

a plurality of first brackets, each of said first brackets being elongated in a vertical direction, having a first elongated rear wrapping wall with a concave-profiled rear face for abutting and wrapping around a portion of the circumference;

first left and right side walls extending outwardly from said first wrapping wall; and a plurality of blind fasteners for securing said plurality of first wrapping walls to the pole wall, wherein said plurality of first wrapping walls defines a plurality of through openings configured to align with complementary pole through openings defined in the pole wall circumference, the plurality of blind fasteners configured to secure said plurality of first wrapping walls to the pole wall through said through openings in said plurality of first wrapping walls and through said complementary pole through openings defined in the pole wall circumference;

wherein, when said plurality of first brackets is arranged side by side, with slight gaps between the first left side wall of each first bracket and the first right side wall of an adjacent first bracket, said plurality of first wrapping walls forms a first tubular shape with a diameter, for wrapping around the circumference;

wherein said first left and right side walls define a plurality of aligned openings; and further comprising a plurality of bolts and nuts, wherein said bolts extend through said aligned openings to secure the adjacent first side walls of adjacent first brackets together, such that tightening said nuts on said bolts reduces the diameter of said tubular shape in order to press said first concave-profiled rear faces of said first wrapping walls against and securely in direct contact with said circumference.

7. An arrangement for reinforcing a pole wall having a circumference as recited in claim 6, wherein the pole wall circumference tapers from a greater diameter at a lower portion to a lesser diameter at an upward portion, and wherein the plurality of brackets are configured to taper in similar manner to accommodate the tapering of the pole circumference.

* * * * *